US010301874B1

(12) United States Patent
Halloran et al.

(10) Patent No.: US 10,301,874 B1
(45) Date of Patent: May 28, 2019

(54) ACCESSORY ATTACHMENT FOR LADDERS

(71) Applicant: Alex Lan, Dublin, CA (US)

(72) Inventors: Kevin John Halloran, Castro Valley, CA (US); Michael Halloran, Walnut Creek, CA (US)

(73) Assignee: Alex Lan, Dublin, CA (US)

( * ) Notice: Subject to any disclaimer, the term of this patent is extended or adjusted under 35 U.S.C. 154(b) by 0 days.

(21) Appl. No.: 15/893,473

(22) Filed: Feb. 9, 2018

Related U.S. Application Data

(60) Provisional application No. 62/708,723, filed on Dec. 19, 2017.

(51) Int. Cl.
*E06C 7/14* (2006.01)

(52) U.S. Cl.
CPC ..... *E06C 7/143* (2013.01)

(58) Field of Classification Search
CPC ..... E06C 7/143
USPC ..... 248/210, 211, 238; 182/120, 26, 214, 182/121; 211/60 T
See application file for complete search history.

(56) References Cited

U.S. PATENT DOCUMENTS 1,114,921 A * 10/1914 Selstad ..... E06C 7/14 248/210
1,508,392 A * 9/1924 Heun ..... E06C 7/48 182/214
1,641,531 A * 9/1927 Corcoran ..... A61J 9/0638 248/103
1,880,319 A * 10/1932 Iasillo ..... E06C 7/14 248/211
2,100,918 A * 11/1937 Ringman ..... E06C 7/48 182/107
2,179,119 A * 11/1939 Failla ..... E06C 1/32 182/26
2,686,033 A * 8/1954 Keiter ..... E06C 7/14 248/211
3,223,369 A * 12/1965 Benninger, Jr. ..... E06C 7/143 182/129
3,239,181 A * 3/1966 Ellerbrock ..... B44D 3/14 248/210
3,246,867 A * 4/1966 Ewing ..... E06C 7/14 24/486
3,313,506 A * 4/1967 Bauchard ..... B05C 21/00 248/210
3,759,474 A 9/1973 Narkie
3,985,203 A * 10/1976 Erlenbach ..... E06C 7/143 182/120
4,186,903 A * 2/1980 Fazakerley ..... E06C 7/143 248/210
4,489,911 A * 12/1984 Riley ..... E06C 7/143 182/121
4,660,794 A * 4/1987 Given ..... E06C 7/188 182/120
4,662,594 A * 5/1987 Dubis ..... E06C 7/143 248/231.21
4,702,446 A * 10/1987 Brown ..... E06C 7/143 182/129
4,991,808 A 2/1991 LaChance
(Continued)

*Primary Examiner* — Kimberly T Wood
(74) *Attorney, Agent, or Firm* — Thomas M. Freiburger

(57) ABSTRACT

An accessory holder for a ladder, such as an extension ladder, has a main body that attaches to the side rail of a ladder via the hollow interior of a rung, and has various adjustable hooks or arms that are configured to hold paint buckets, tools, brushes and other items for a painter or other tradesman.

2 Claims, 3 Drawing Sheets

(56) References Cited

U.S. PATENT DOCUMENTS 5,031,723 A * 7/1991 Hooten ..... E06C 1/38 182/120
5,135,193 A * 8/1992 Parris ..... E06C 7/143 182/129
5,181,682 A * 1/1993 Indelicato ..... E06C 7/143 248/210
5,191,954 A * 3/1993 Ledford ..... E06C 7/143 182/121
5,259,525 A * 11/1993 Wion ..... E06C 7/143 220/737
5,316,251 A * 5/1994 McGraw ..... E06C 7/143 248/210
5,649,682 A * 7/1997 Martin ..... E06C 7/143 248/210
5,687,941 A * 11/1997 Quintile ..... E06C 7/14 248/210
5,960,905 A * 10/1999 Gardner ..... E06C 7/143 182/129
6,076,636 A * 6/2000 Tietge ..... E06C 7/143 182/129
6,338,459 B1 * 1/2002 Biggs ..... E06C 7/14 182/129
7,967,264 B1 * 6/2011 Peterson ..... E06C 7/143 182/115
9,732,558 B2 * 8/2017 Ayala ..... E06C 7/143
2006/0278767 A1 * 12/2006 Martineau ..... E06C 7/143 248/77
2008/0017771 A1 * 1/2008 Anderson ..... E06C 7/143 248/238
2013/0140423 A1 * 6/2013 Taylor ..... E06C 7/143 248/544
2013/0192924 A1 * 8/2013 Paun ..... E06C 7/143 182/129
2013/0256481 A1 * 10/2013 Saucier ..... E06C 7/143 248/210

* cited by examiner

ACCESSORY ATTACHMENT FOR LADDERS

This application claims benefit of provisional application No. 62/708,723, filed Dec. 19, 2017.

BACKGROUND OF THE INVENTION

This invention concerns apparatus for attachment to ladders, particularly ladders having hollow rungs, and specifically the invention is a device that attaches to the side of a ladder to provide for hanging buckets, tools, accessories and supplies in a convenient and readily retrievable manner without occupying space between the ladder rails.

Various devices have been designed for attachment to ladders, usually on the rungs of the ladder. For example, ladder jacks are attached to ladder rungs to support scaffold planks, on a single ladder or between two ladders. An example of a ladder jack is shown in U.S. Pat. No. 3,759,474. Another ladder attachment apparatus is shown in U.S. Pat. No. 4,991,808, a device to support a tray or other fittings to carry a paint pan, paint buckets, etc. The devices of both these patents engage with two successive rungs of a ladder. Ladder hooks are also common, for attachment to a ladder rung to hang a bucket of paint, for example.

Previous ladder attachments have not provided the convenience, ease of use and safe multiple bucket carrying capacity of the invention described below.

SUMMARY OF THE INVENTION

The article supporting device of the invention differs from ladder jacks, ladder hooks and other devices that engage on the rungs of a ladder, between the rails. The invention provides convenient supporting arms or hooks to the side of the ladder, in positions to be readily retrieved, without occupying any space between the ladder rails, i.e. on the rungs. The device is thus safer in use than rung-attached devices.

The article supporting apparatus of the invention is a simple, lightweight and easily carried and stored device that attaches to the outside of a ladder rail via the hollow interior of a rung. The device can be formed of an essentially flat bar preferably of metal as a main body, with a dowel attached to and extending at right angles to the main body and sized to fit within the hollow interior of a ladder rung, inserted from the outer side of the side rail. At the front of this main body, forward of the dowel, is a front retention bracket configured to engage the front edge of the ladder rail to prevent lateral movement, i.e. pulling out of the dowel, after the device has been installed. The main body supports several arms, adjustable in position, for hanging articles within reach of the user. In a preferred embodiment two of these adjustable arms are at the rear end of the main body, so as to support articles near the back side of a ladder rail, and a further obliquely angled support arm can be provided when desired by the user at a front end of the main body. Multiple buckets, such as paint buckets, can be safely and conveniently hung from these arms.

It is an object of the invention to enable a tradesman to conveniently hang and retrieve or have easy access to articles such as paint buckets, tools, buckets containing other supplies, etc., using a lightweight and easily stored and carried apparatus that attaches to the ladder without occupying any of the rung space between the rails. These and other objects, advantages and features of the invention will be apparent from the following description of a preferred embodiment, considered along with the accompanying drawings.

DESCRIPTION OF PREFERRED EMBODIMENTS

Figure 1:
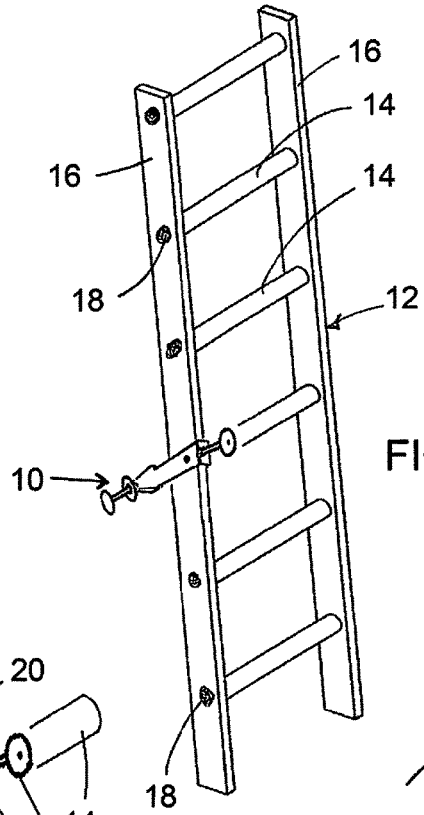
FIG. 1 is a perspective view showing a device according to the invention, attached on a ladder.
Figure 2:
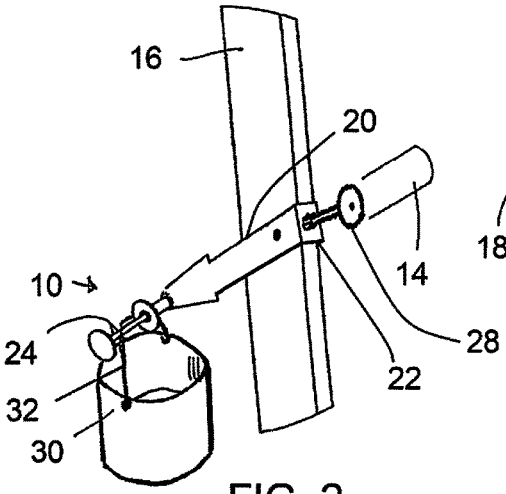
FIG. 2 is an enlarged perspective view showing the device in greater detail.

FIG. 1 shows a support device 10 of the invention attached on a ladder 12. The ladder 12 typically will be an extension ladder, or in any event a ladder having cylindrical rungs 14 that have hollow interiors which are open at ladder rails 16, as shown at 18 in FIG. 1. FIG. 2 shows the device 10 as connected to the rail 16 and rung 14 in greater detail.

The article supporting device 10 has a main body 20 preferably configured as a flat metal bar, or a bar of sufficiently strong alternative material. At the forward end of the main body is a retaining bracket 22, secured to or integral with the main body 20, for retention on the ladder rail 16. As illustrated, the main body supports several arms or hooks 24, 26 and 28 (26 seen in FIGS. 3-6), used to hang one or more paint buckets 30 or other tools, implements or material containers having some form of a handle such as the handle 32, in a convenient place for use by a tradesman working from the ladder.

Figure 3:
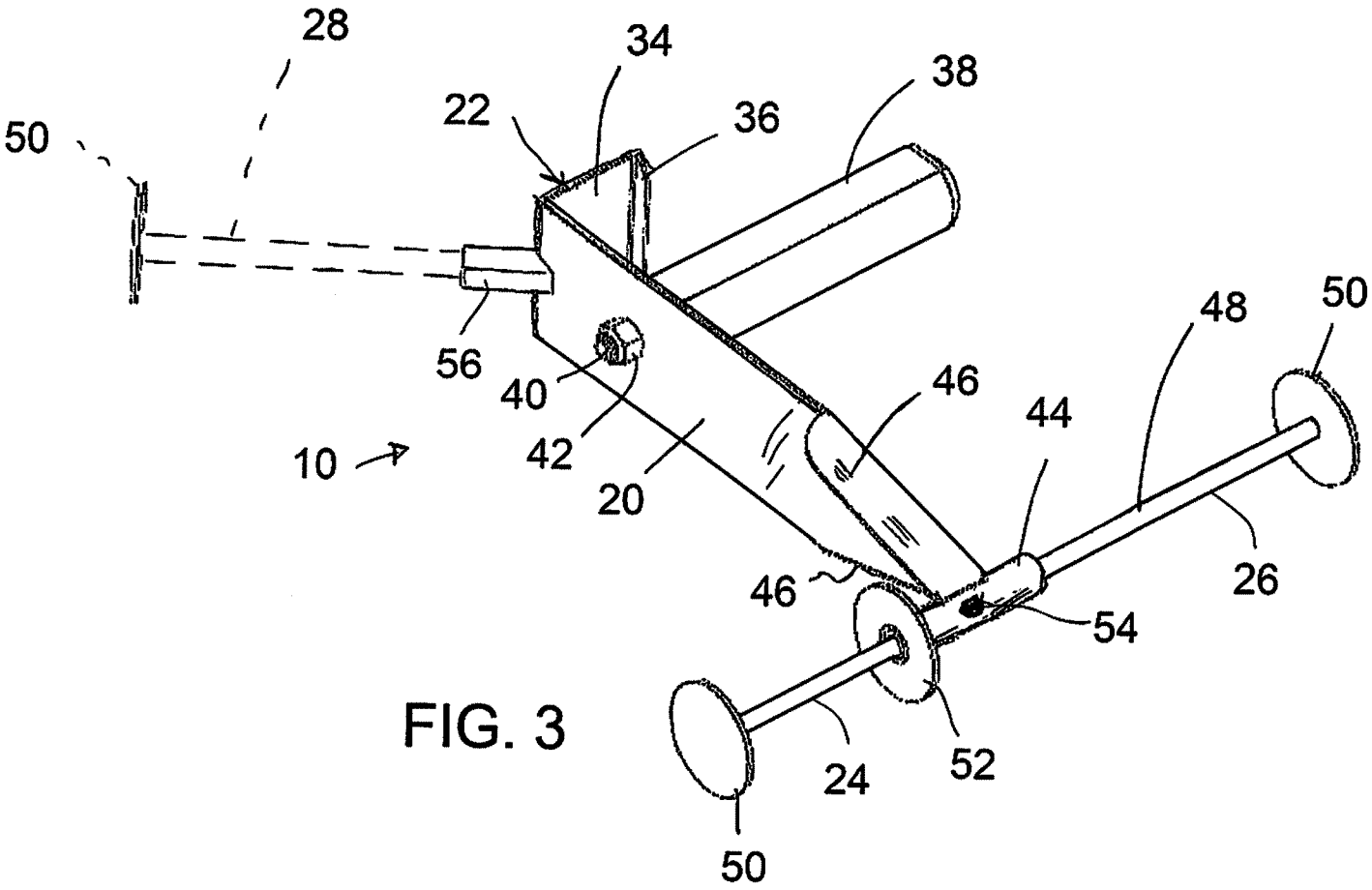
FIG. 3 is another perspective view showing the device of the invention, not attached to a ladder.

FIG. 3 shows the device 10 flipped over, in an orientation for use on the right side rail 16 of the ladder, rather than the left side rail as shown in FIGS. 1 and 2. FIG. 3 shows that the retention bracket 22 has a flat forward section 34 and a back-directed lip 36, at an end of the section 34 which is opposite the position of the main body 20. This prevents lateral movement of the device 10 out from the ladder, as can be envisioned in FIGS. 1 and 2, since the lip 36, when the device is tipped downwardly as shown in FIGS. 1 and 2, will engage against an inner side of the ladder rail 16. The spacing of the lip 36 from the main body piece 20, i.e. the width of the front section 34, is sufficient to engage over the width (narrow dimension) of a typical ladder rail, as shown.

Figure 2A:
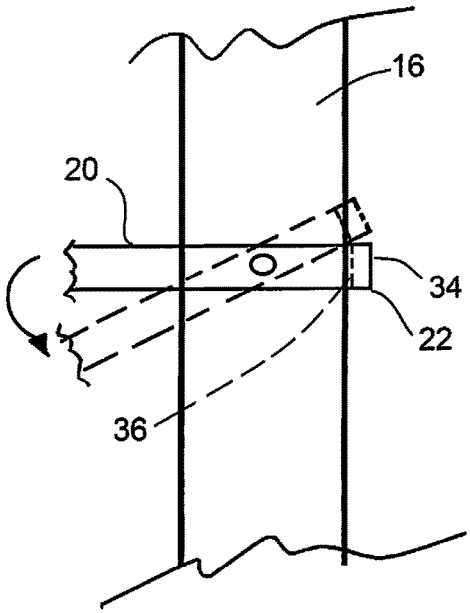
FIG. 2A is a further detail.

FIG. 2A demonstrates this function of the retention bracket 22. In solid lines the main body piece is shown at a rotational orientation perpendicular to the ladder rail 16. Here the back-directed lip 36 (hidden, shown dashed) just clears the edge of the ladder rail 16. However, when the body piece 20 is rotated by carrying a load at the rear, to the position shown in dashed lines in FIG. 2A, the bracket end 22 swings upwardly, placing the back-directed lip 36 behind the edge of the ladder so that outward movement of the device 10 from the ladder rail is prevented.

A dowel 38, of wood, steel, aluminum, FRP or other appropriate material (which could be coated with a rubbery material if desired), is secured to the main body 20 as shown, extending essentially perpendicularly. The dowel is inserted into a hollow interior 16 of a ladder rung, the rungs often being D-shaped in cross section. This dowel (or approximate dowel, the term dowel not being limited to cylindrical shapes), may itself be D-shaped, or simply of a diameter to fit in most ladders. The dowel is retained in place by a machine bolt 40 which can pass through the dowel and a nut 42, as shown. The threaded bolt 40 could alternatively have tapered threads on its opposite end (not visible in the drawings), screwed into a bore of a wooden dowel 38, or a lag screw could be used, screwed into a base if the dowel and the head of the screw against the body 20. If the dowel 38 is metal, the bolt 40 could simply be a stud welded onto the end of the metal dowel or machined when the dowel is formed, or a machine bolt could be screwed into a threaded bore in the metal dowel. The dowel 38 is spaced from the lip 36 by a distance such that the device 10 can be installed by holding the main body with its length perpendicular to the length of the ladder rail 16 and inserting the dowel, and the lip 36 will just clear the rail. With the device 10 angled down in use as in FIGS. 1 and 2 the lip will prevent it from moving outwardly, i.e. prevent the dowel 38 from pulling outwardly from the rung.

Figure 7:
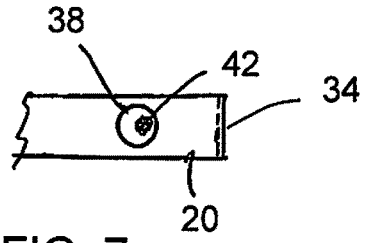
FIG. 7 is a partial side view of the device showing a detail.

FIG. 7 shows an alternative dowel attachment scheme to provide adjustment in the distance between the dowel and the bracket lip 36, so as to provide for ladders with deeper or shallower rung positions in the ladder's rails. The bolt 42 is off-center in the dowel 38, and the bolt/nut can be loosened and re-tightened to set the dowel for different ladders. Note that a dowel diameter of one inch can fit into the rungs of nearly all rung ladders, even though the rung interior may be D-shaped.

An alternative to the FIG. 7 arrangement would be to have several holes in the main body plate 20, each with a different distance from the end 34, such that the bolt 40 could be removed and replaced in a different hole for different ladder configurations.

As shown in the drawings, the rear arms or hooks 24 and 26 can be secured via a cylindrical slide bushing 44 to the main body 20. This connection, with the slide bushing 44 basically perpendicular to the flat main body piece 20, can be made in any structurally secure way. In the embodiment illustrated, the securement is via two flat plates 46 connected to upper and lower edges of the main body 20, which is tapered to a narrower dimension at its end, and with the ends of the flat plates 46 welded or otherwise secured to the cylindrical slide bushing 44. The flat plates 46 can be welded onto the main body, or they can be formed by bending the plate of the main body, as shown, to one side at the top and to the opposite side at the bottom, so that the two plates 46 are staggered in position. See also FIG. 2 and FIGS. 4-6. Alternatively, they could be fixed onto the body 20 by fasteners.

The hooks 24, 26 can take any of several forms. They could have actual hooks at their ends, they could curve down into a hook shape, or they can simply be two ends of a linear rod 48 as shown, each end having a retaining disk 50 secured to the end. A further disk 52 can be fixed to the end of the slide bushing 44 as shown in FIG. 3, and in this way a space is made for hanging the handle 32 of a paint can or bucket 30 as in FIG. 2.

The rod 48 can be adjusted in position by sliding it within the bushing 44. A set screw 54 threaded through the wall of the bushing 44 is used to lock the rod 48 in the selected position. If desired another disk such as 52 could be provided at the opposite end of the bushing 44 (not shown).

The figures also show the forward obliquely-angled arm or hook 28. This is shown in dashed lines in FIG. 3, as it is optional for the user. In a preferred embodiment an internally threaded block or nut member 56 is secured to the main body 20 (or the retention bracket 34), oriented at an oblique angle such as 45°, to receive the threaded end of the article supporting arm 28, when needed.

Figure 4:
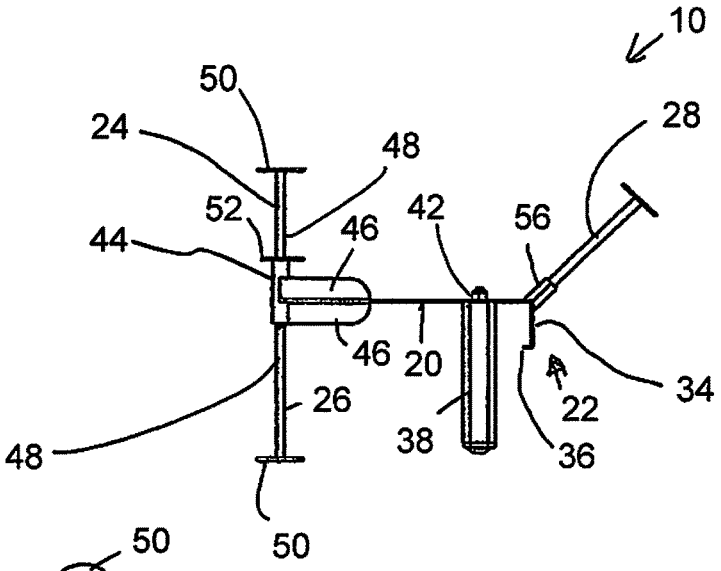
FIG. 4 is a plan view showing the device.
Figure 5:
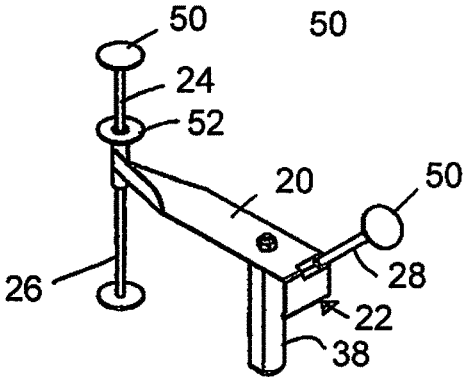
FIGS. 5 and 6 are perspective views of the device from two different angles.
Figure 6:
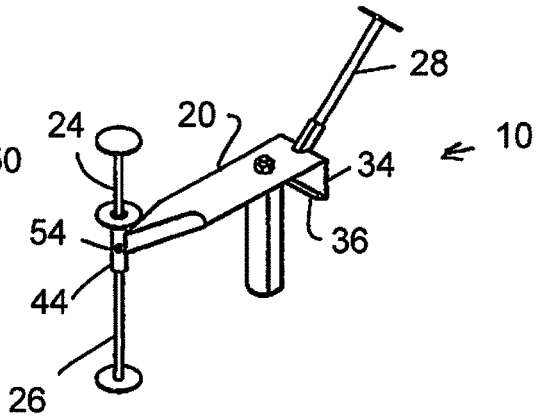

FIGS. 4, 5 and 6 provide additional views of the invention. These views show the structural plates 46, in the form of bendings from sides of the main body 20, for securing the slide bushing 44 as described below.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. An article carrying device for attachment to a side rail of a ladder, comprising:

a main body piece configured to be attached to the side rail of a ladder, to be positioned such that a length of the main body piece extends across the side rail, a dowel having one end secured to the main body piece and extending generally perpendicularly from the main body piece, the dowel being of a size to fit within a hollow center of a ladder rung of the ladder, the main body piece being having a securing bracket at a front end of the main body piece, the securing bracket including a front section essentially perpendicular to the main body piece and parallel to the dowel, and an end of the front section opposite the main body piece having a lip extending rearwardly, in a position to grip the side of a ladder's side rail when the carrying device is installed, a plurality of adjustable arms connected to and supported on the main body piece configured to support buckets, tools and supplies useful to a tradesman working on the ladder, two said adjustable arms formed by a rod at a rear end of the main body piece, the rod having enlarged heads at each of two ends, and the rear end of the main body piece having a slide bushing within which the rod is positioned, and including a set screw threaded into the slide bushing for adjusting a slidable position of the rod.

2. An article carrying device for attachment to a side rail of a ladder, comprising:

a main body piece configured to be attached to the side rail of a ladder, to be positioned such that a length of the main body piece extends across the side rail, a dowel having one end secured to the main body piece and extending generally perpendicularly from the main body piece, the dowel being of a size to fit within a hollow center of a ladder rung of the ladder, the main body piece being having a securing bracket at a front end of the main body piece, the securing bracket including a front section essentially perpendicular to the main body piece and parallel to the dowel, and an end of the front section opposite the main body piece having a lip extending rearwardly, in a position to grip the side of a ladder's side rail when the carrying device is installed, a plurality of adjustable arms connected to and supported on the main body configured to support buckets, tools and supplies useful to a tradesman working on the ladder, and wherein the securing bracket on the main body piece is spaced from the dowel a distance such that, with the main body piece in a position perpendicular to the length of the ladder's side rail, the dowel can be slid into the hollow interior of the ladder rung with the lip clearing a front edge of the ladder rail, but with the dowel fully inserted into the ladder and the device rotated relative to the ladder such that a back end of the main body piece extends downwardly and the securing bracket is swung upwardly, the lip will engage with the ladder's side rail, preventing the dowel from escaping from the ladder rung.

* * * * *